US005281103A

United States Patent [19]

Lin

[11] Patent Number: 5,281,103

[45] Date of Patent: Jan. 25, 1994

[54] MINI TABLE FAN

[76] Inventor: Yung-Her Lin, 6FL, No. 75, Sec. 1, Chang-An E.Rd., Taipei City, Taiwan

[21] Appl. No.: 952,100

[22] Filed: Sep. 28, 1992

[30] Foreign Application Priority Data

Sep. 30, 1991 [JP] Japan ..... 3-100058[U]

[51] Int. Cl.[5] ..... F04B 21/00

[52] U.S. Cl. ..... 417/234; 417/411; 417/423.15; 416/142; 416/146 R; 416/204 R

[58] Field of Search ..... 416/142, 146 R, 169 R, 416/204 R; 417/234, 411, 423.15

[56] References Cited

U.S. PATENT DOCUMENTS 349,855 9/1886 Murray, Jr. ..... 416/169 R
1,577,502 3/1926 Tabor ..... 416/142
4,341,151 7/1982 Sakamoto ..... 417/234

FOREIGN PATENT DOCUMENTS 0029798 2/1987 Japan ..... 416/204 R

*Primary Examiner*—Edward K. Look
*Assistant Examiner*—Christopher M. Verdier
*Attorney, Agent, or Firm*—Bacon & Thomas

[57] ABSTRACT

A fan is contained within a case having a pivotal upper portion and a lower portion whereby opening the upper portion raises the fan blade and motor assembly to an operating position and during which a limit switch is automatically actuated to operate the fan motor. The fan blade is also provided with a frictional engagement with the motor shaft for permitting the motor shaft to rotate relative to the fan blade when the latter strikes an obstruction.

3 Claims, 3 Drawing Sheets

MINI TABLE FAN

BACKGROUND OF THE INVENTION

1. Field of the Invention

This invention relates to a portable, convenient, and safe mini table fan, especially a fan which has a power source switch means that is easy to turn on and off and which has a safety blade means which can protect the motor and make it more durable.

2. Description of the Prior Art

The conventional mini fan has a slide switch which limits the possibility of making diverse designs for its exterior. It is dull and occupies much room. It usually uses a grille to cover the fan in order to protect the users from being hurt by its blade. Though the grille can protect the users, it also increases its volume and makes the fan much more inefficient. And it makes the fan difficult to clean. So this kind of conventional fan can not attract consumers.

SUMMARY OF THE INVENTION

The object of the present invention is to provide an effective mini table fan which avoids turbulent flow.

Another object is to provide a mini table fan which is durable and amusing to operate.

Another object is to provide a mini table fan which is safe to use.

Still another object is to provide a mini table fan which is portable and easy to store.

DETAILED DESCRIPTION OF THE PREFERRED EMBODIMENT

Figure 1:
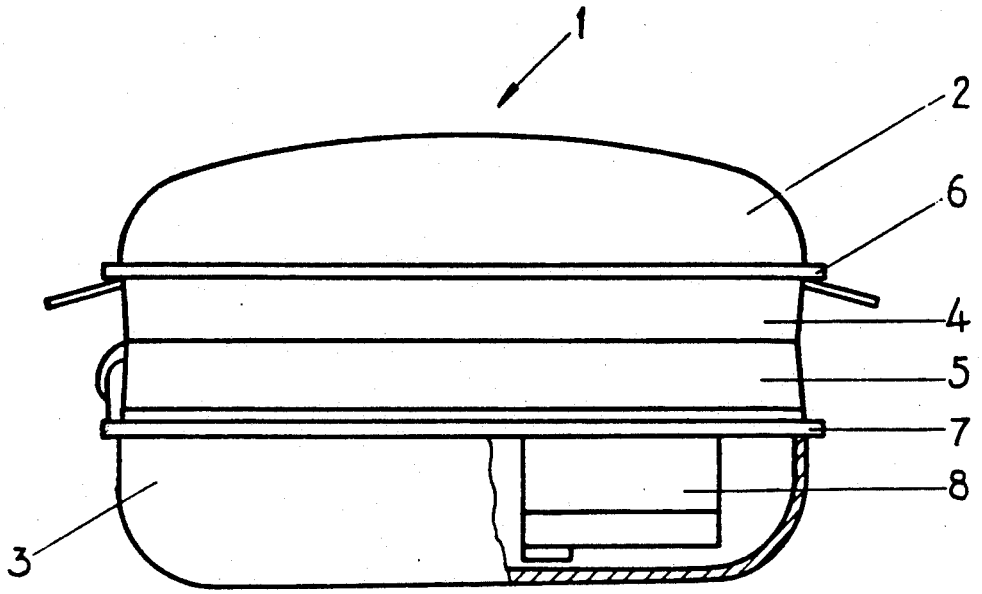
FIG. 1 is a side view of the invention, partly in section, showing the each portion of the case.
Figure 2:
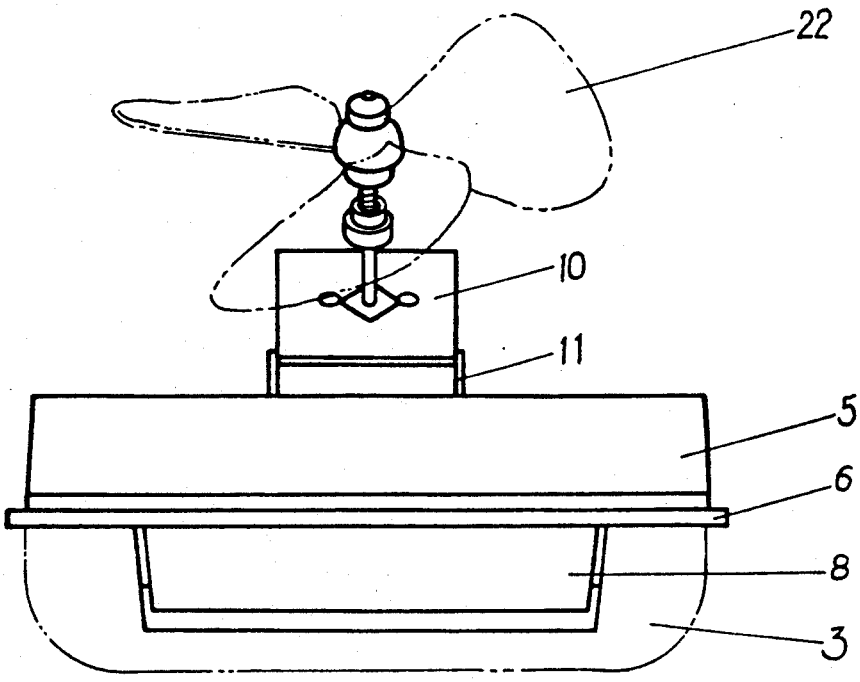
FIG. 2 is a front view of each element when the upper portion of the case is open and the motor is lifted.
Figure 3:
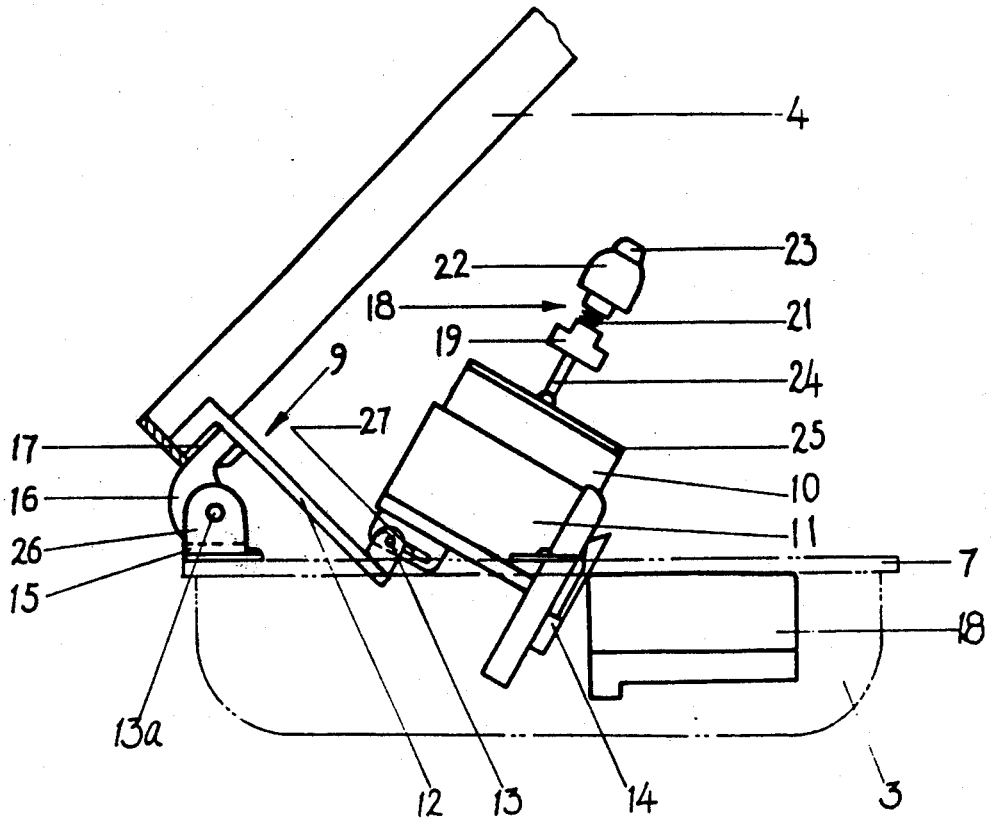
FIG. 3 is a side view of the power source switch means and safety blade means to show their relationship with the main body.

As shown in FIG. 1 and FIG. 3, this invention is composed of a case (1), a power source switch means (9), and safety blade means (18) wherein the case (1) consists of an upper portion and a lower portion. The upper portion which is pivotally joined to the lower portion can be opened and closed so that the portions form a space for a switch means. The fan and the motor are fitted on the upper side of the switch means. By means of the opening and closing of the upper portion of the case, the switch means can be moved to lift, lower down, or close the fan. This can be illustrated clearly with the drawing figure as follows: As shown in FIG. 1, case (1) is composed of its upper portion and lower portion which are hollow and shaped like a cap. The two portions form a space for the rest of the elements. The upper portion is comprised of an upper cover (2), upper bottom board (6), upper collar cover (4): whereas the lower portion is comprised of lower collar cover (5), lower bottom board (7), and lower cover (3). A battery seat (8) is mounted in a proper position on the lower portion for mounting a battery (not shown) to operate the fan.

Figure 4:
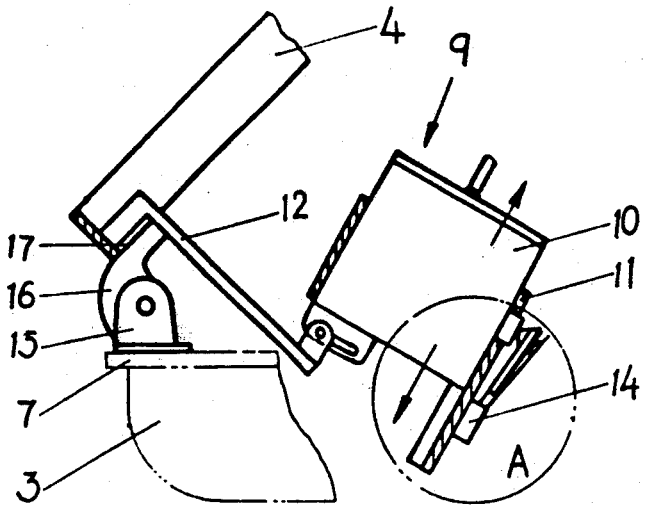
FIG. 4 is a view of the structure of the power source switch means to show the corresponding position of each elements of the invention and their motion condition when the switch means is in "on" position.

As shown in FIG. 4, power source switch means (9) consists of a rotating axle seat (16), a fixed axle seat (15), a coupling lever (12), a motor seat (10), a sliding seat box (11) and a limit switch (14). The fixed axle seat (15) is fitted on the lower bottom board (7) which has a mouth to accommodate the rotating axle seat (16). One end of the rotating axle seat (16) is fixed on the side flange (17) of the upper portion of the case (1). The other end of the axle seat (16) is rotatably pin-jointed to the mouth of the fixed axle seat. One end of the coupling lever (12) is fitted to the upper portion of the case (1).

The other end of the coupling lever (12) is slidingly pin-jointed to the pin hole (27) in the back of the motor seat (10). The sliding seat box (11) is fitted on the lower bottom board (7) by a slant angle of 60 degree. The upper portion of the sliding seat box has a space and its lower portion has a sliding rail which has two leading rails (28, 28*a*) on its both ends. Between these two rails there is disposed a leading hole (29). A limit switch (14) is disposed below the leading hole (29) and electrically connected to the motor. The motor seat (10) is slidingly disposed in the room of the sliding seat box (11). The room of the seat box can be used to accommodate the motor. The lower portion of the seat box is provided with a thumb latch (30) which can slide upward and downward in the loading hole (29) of the extended sliding rail of the sliding seat box. The operation of this means can be illustrated as follows:

When the upper portion of the case (1) is open, one end of the coupling lever (12) will rotate around the pin (13). The other end of the coupling lever (12) will lift the motor seat (10) up to a slant angle of 60 degree along the sliding seat box (11). The thumb latch (30) below the motor seat (10) will slide along the leading hole (29). As shown in FIG. 4, when the upper portion of the case is fully open, motor seat (10) will lift to the highest position and the thumb latch (30) will touch the limit switch (14) and close the electric circuit and actuate the motor. Because motor seat is lifted, it can provide a large room for the fan and can avoid turbulence so that the fan can operate efficiently.

Figure 5:
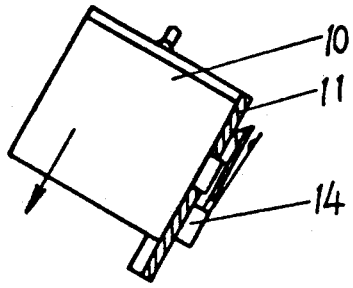
FIG. 5 is a view of the power source switch means in "off" position to show the position of the motor and the motion of the limit switch.
Figure 6:
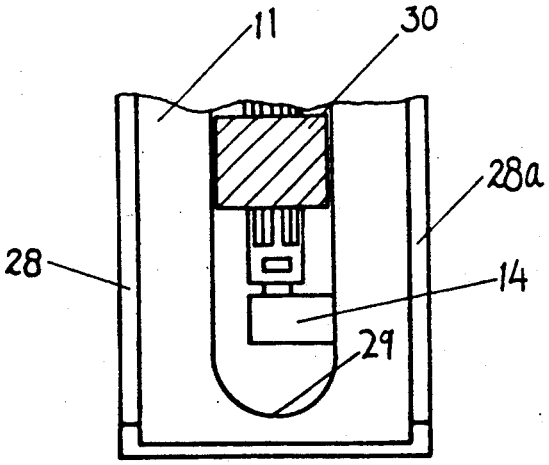
FIG. 6 is an auxiliary view of the A portion in FIG. 4 to show the thumb latch in the leading hole.
Figure 7:
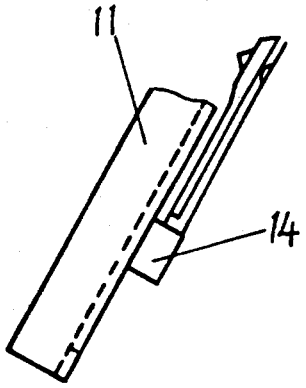
FIG. 7 is a side view of FIG. 6 showing the positions of the sliding seat box and the limit switch.

As shown in FIG. 5, when the upper portion of the case (1) begins to close, the thumb latch will depart from the limit switch (14) and the power source will break immediately; that is, only when the upper portion of the case is fully open, can the fan operate and rotate. So it is very safe to operate the fan. And this manner of starting a fan may make the operation interesting and amusing. When the upper portion is completely closed, the motor will lower down and the fan will retrieve into the case. To solve the problem that the upper portion of the case will automatically close down because of its weight, a friction piece (26) is attached to the rotating axle seat (16) so that the rotating axle seat can stop at any time. So when the upper portion is completely open, it can be supported and secured by the friction piece (26) and will not close down again.

Figure 8:
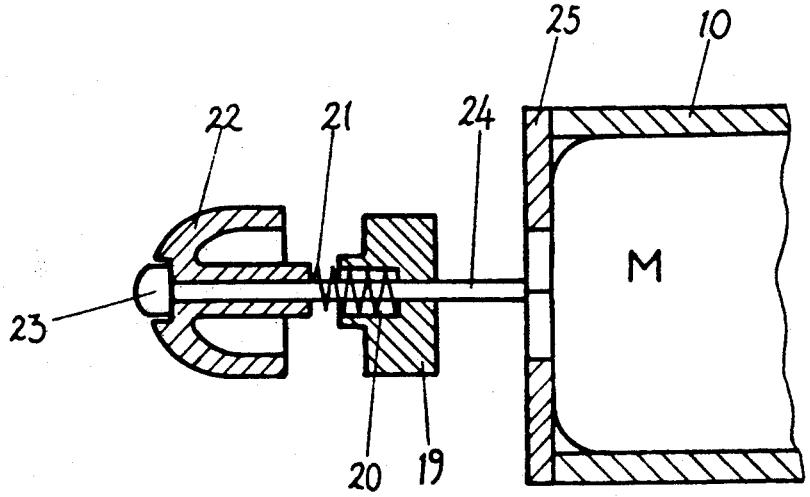
FIG. 8 is a sectional view of the safety blade means showing the opposite positions of each element.

As shown in FIG. 8, the safety blade means consists of a resistance piece (19), compression spring (21), fan blade (22), and screw cap (23). Each of these elements is fitted on the motor coil shaft (24). The resistance piece (19) is fixed on the motor coil shaft (24) and it will rotate with the motor coil shaft. The front end of the resistance piece has a space (20).

The spring (21) is mounted in the space (20) in front of the resistame piece (19), and the other end is connected to the fan blade (22) which can be freely rotatably mounted on shaft 24 at the front end of the spring (21). The front end of the fan blade (22) is secured by means of a screw cap (23). The operation of this means can be illustrated as follows:

The purpose of this safety means is to provide a spring to protect the blade (22). Under normal condition, one end of the spring (21) is pressed in the space (20) of the resistance piece (19). The other end is pushed against the blade (22) and creates a friction between the blade and the screw cap (23). By means of this friction, the fan blade can rotate freely. When the blades receive an external pressure which is larger than any friction force made between blade (22) and screw cap (23), or between the blade (22) and the spring (21), or between the spring (21) and the resistance piece (19), the blade (22) will stop rotating because it loses dynamic force and stops. By this way, the users can be protected from being hurt by the blade (22). At this moment, the motor keeps its idle running. When the external force disappears, the spring (21) works to press the blade (22) against the screw cap (23) and the fan starts to operate normally again. This safety means is effective and protective. Because the rotating motor does not bear the pressure of the spring (21), the transmission force of the motor is weak. When the blade (22) is touched by the users, the safety means works to keep the motor running idly. So this safety means can protect the motor coil from being burned and can prolong the life of the motor.

What is claimed is:

1. A mini table fan comprising:

a) a case including an upper portion and a lower portion defining a storage space therebetween, the upper portion being pivotally connected to the lower portion for opening and closing the case;

b) a sliding seat box mounted to the lower portion of the case at an angle from a horizontal reference;

c) a motor seat slidably mounted on the sliding seat box for movement between an upper position of use and a lower position of storage, a motor mounted on the motor seat and including a motor shaft and a fan blade mounted on the motor shaft;

d) an electric power source, an electric circuit for connecting the electric power source to the motor and a limit switch carried by the sliding seat box for closing the electric circuit to operate the motor when it is in the upper position of use and open the electric circuit to turn off the motor when it is in the lower position of storage; and e) a coupling lever connecting the upper portion of the case and the motor seat for automatically raising the motor to the position of use during opening of the upper portion and lowering the motor to the position of storage during closing of the upper portion.

2. The mini table fan of claim 1 further including:

a) the fan blade being freely rotatably mounted on the motor shaft;

b) a resistance means carried by the motor shaft; and c) resilient means disposed between the resistance means and the fan blade for transmitting the torque of the motor shaft to the fan blade during normal operation of the fan and permitting the motor shaft to rotate relative to the fan blade when the fan blade strikes an obstruction.

3. The mini table fan of claim 1 wherein the sliding seat box and the motor seat are both disposed at an angle of approximately 60° from the horizontal reference.

* * * * *